US008998551B2

(12) United States Patent
Guillory, Jr. et al.

(10) Patent No.: US 8,998,551 B2
(45) Date of Patent: Apr. 7, 2015

(54) TUBULAR POSITIONING SYSTEM

(75) Inventors: Nestor D. Guillory, Jr., Carencro, LA (US); Robert W. Menard, Youngsville, LA (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 13/267,094

(22) Filed: Oct. 6, 2011

(65) Prior Publication Data

US 2013/0089393 A1 Apr. 11, 2013

(51) Int. Cl.
*E21B 19/00* (2006.01)
*E21B 19/15* (2006.01)

(52) U.S. Cl.
CPC ..... *E21B 19/155* (2013.01)

(58) Field of Classification Search
CPC ..... E21B 19/00; E21B 19/14; E21B 19/15; E21B 19/155; E21B 19/20
USPC ..... 414/22.51–22.71; 384/42
See application file for complete search history.

(56) References Cited

U.S. PATENT DOCUMENTS 3,464,882 A * 9/1969 Morton ..... 428/375
3,690,742 A * 9/1972 Sung ..... 384/42
4,470,740 A * 9/1984 Frias ..... 414/22.61
5,788,621 A * 8/1998 Eady ..... 494/37
5,829,606 A * 11/1998 Erdmann ..... 212/350
6,079,925 A * 6/2000 Morgan et al. ..... 414/22.57
6,109,394 A * 8/2000 Messenger ..... 184/99
6,877,942 B2 * 4/2005 Eastcott ..... 414/22.54
6,994,505 B2 2/2006 Hawkins, III
7,021,880 B2 * 4/2006 Morelli et al. ..... 414/22.59
7,140,453 B2 * 11/2006 Ayling ..... 175/52
7,195,730 B2 * 3/2007 Calderoni et al. ..... 264/279
8,016,536 B2 * 9/2011 Gerber et al. ..... 414/22.61
2010/0252274 A1 * 10/2010 Buytaert et al. ..... 166/380

OTHER PUBLICATIONS

"Frank's Catwalk Laydown Machine", Frank's Casing Crew & Rental Tools, Inc., 2003, <http://www.frankscasing.com/Images/Interior/catwalk%20laydown.pdf>: 1 page.

* cited by examiner

*Primary Examiner* — Saul Rodriguez
*Assistant Examiner* — Lynn Schwenning
(74) *Attorney, Agent, or Firm* — Jeffery R. Peterson; Brandon S. Clark; William F. Ryann

(57) ABSTRACT

A system for delivering a downhole tubular from a rack at an oilfield surface to a rig floor thereat. The system includes a trough for accommodating the tubular that is slidably engaged with a lift frame in a sledded fashion. Thus, for delivery of the tubular, the trough may be sleddingly extended from the lift frame. That is, as opposed to a roller type of coupling between the trough and tubular, a sledded coupling is utilized that may require comparatively less maintenance and mobilization time. This may be particularly the case where lighter weight tubulars of less than about 1,000 lbs., preferably under about 500 lbs., are being delivered.

16 Claims, 5 Drawing Sheets

TUBULAR POSITIONING SYSTEM

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. Once more, perhaps even more emphasis has been directed at initial well design and construction. All in all, careful attention to design and construction efficiencies may help maximize return on the substantial investment dedicated to oilfield operations.

In the case of well construction, careful attention and planning may be devoted to the specific architecture, drilling, casing and other hardware installations involved in what is generally referred to as 'completions' operations. Completions operations generally involve the positioning of large scale surface equipment at the oilfield. For example, a rig is located over a well head to serve as a platform for equipment access in drilling the well, installing various hardware or downhole devices, or to provide access for later well interventions.

In the case of initial installations, a variety of tubulars are often provided downhole from the rig floor. For example, casing segments to help support and define the well may be transported one by one into the well from the rig floor. This is no small feat given that each 20-40 foot casing segment is generally several thousand pounds of stainless steel tubing, up to a few feet in diameter. Thus, even getting the segments safely and efficiently to the rig floor for subsequent well installation is no small feat.

The noted heavy casing is generally pulled to the area of the rig floor by way of a rig elevator which may consist of a strap or cable at the end of a crane. That is, an operator at the rig floor may secure the strap about a collar of the casing segment thereby allowing the segment to be pulled upward to a vertical position for subsequent delivery into the well. Due to the massive size of the casing, a positioning system, generally referred to as a 'Laydown' or 'Pickup' Machine, is often used to convey each tubing segment to the vicinity of the rig floor where the noted strap may then be employed to pull the segment up vertically above the floor.

Unfortunately, a pickup machine is a large footspace eating piece of heavy immobile equipment, generally disposed at the oilfield surface on a skid. It may take several operators and multiple 18 wheelers to deliver, position and operate this equipment along with managing a supply of casing tubulars from an associated pipe rack. Once more, in spite of robust construction, the pickup machine is particularly prone to wear and failure. Specifically, a considerable amount of time and effort is dedicated to ensuring that a gantry system of rollers remains operable. This roller system is utilized to extend a trough accommodating each casing segment, one by one, toward the rig floor. Due to the amount of weight accommodated and the moving parts involved, such a system is prone to rapid wearing.

In addition to the massive size and failure modes of a pickup machine, it is also a very expensive piece of equipment, perhaps upwards of $250,000 in today's numbers. Once more, such drawbacks are particularly noteworthy where smaller, lighter weight specialty tubulars are involved. For example, even where lighter weight, say 500-600 lb. production tubing, is to be installed, the same type of large-scale pickup machine is generally employed. This is because, in spite of the lighter weight, such specialty tubing segments are generally of similar lengths, thus benefitting from the trough type of loading and extension delivery to the area of the rig floor.

Trough loading and extension also provide vastly improved safety as compared to say strap pickup from the oilfield surface. For example, a broken strap with the tubular resting at least partly more stably in a trough is much less likely to result in operator injury than a broken strap with the tubular fully suspended in mid air, perhaps 10 feet or more off the ground. As a result, even though the pickup machine is particularly prone to wear of its gantry system and may constitute overkill in terms of delivery capacity when utilized for lighter specialty tubulars, it nevertheless remains the preferred mode of tubular delivery to the rig floor.

SUMMARY

A downhole tubular positioning system is provided. The system is configured for locating at an oilfield surface in conjunction with a rig to aid in delivery of downhole tubular to a well. A mobile lift frame and trough are included with the system. More specifically, the lift frame is configured for elevating to a level approaching that of a floor of the rig. The trough is coupled to the lift frame so as to accommodate a tubular. Once more, the trough is coupled to the lift frame in a sledded manner so as to be slidably extended toward the rig floor. The sledded coupling of the trough to the frame may include unique interfacing. For example, the interfacing may include a runner or broader slider surfaces. In one embodiment, multiple discrete polymeric shoes serving as runners may extend from an underside of the trough for engagement with the frame.

DETAILED DESCRIPTION

Embodiments are described with reference to certain oilfield operations involving the delivery of certain specialty tubulars for well installation. For example, embodiments herein reference production tubing delivery and installation. However, other types of lighter weight tubular deliveries may take advantage of system embodiments and techniques detailed herein. For example, pipe and other completions tubulars may be delivered employing an embodiment of a system as described below. Regardless, embodiments of systems detailed herein employ a trough for extension from a lift frame in a sledding fashion so as to reduce replacement and repair costs where lighter weight tubulars are to be delivered to a rig floor.

Figure 1:
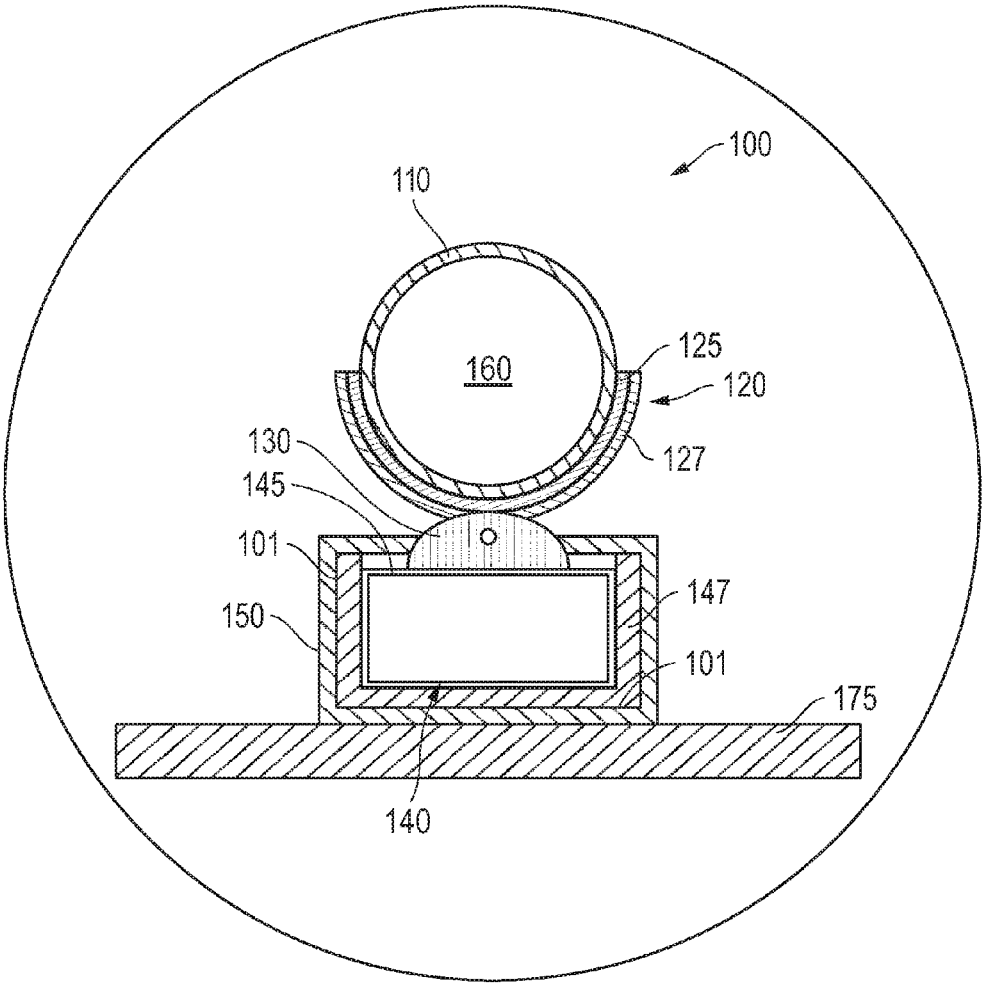
FIG. 1 is a front cross-sectional view of an embodiment of a tubular positioning system.

Referring now to FIG. 1, a front cross-sectional view of an embodiment of a tubular positioning system 100 is shown. In the embodiment shown, the system 100 is configured with a trough 120 to accommodate a 20-40 foot tubular 110 of up to about 500 lbs. or more. Indeed, the tubular 110 depicted may be of such dimension and of between about 500 and 600 lbs., perhaps configured as a production tubular to ultimately transport production fluids through an inner channel 160 thereof. Given the comparatively lightweight nature of the types of tubulars accommodated, the system 100 itself may also be of a sufficiently lightweight nature to allow for mobile transport via a conventional trailer bed 175.

Continuing with reference to FIG. 1, the trough 120 includes an undercarriage 140. That is, the main body of the trough 120 is connected to an undercarriage 140 by way of feet 130 (see also FIG. 2A-2C). Further, the undercarriage 140 itself is made up of an internal beam 145 with outer polymer layer 147 to allow for a sledding interface 101 with a lift frame 150 as detailed further below. In the embodiment shown, the outer polymer layer 147 is in the form of a unitarily broad surface slider. However, the layer 147 may be provided as a narrower rail or runner. In fact, in an embodiment such as that depicted in FIGS. 2C and 5, the layer 147 may be provided in more discrete pad form.

Such sledding interface 101 may minimize variable movement between the frame 150 and the undercarriage 140 as the latter is extended as detailed further below. Thus, locations of focused high stress and wear at the interface 101 may be reduced as compared to a more conventional roller interface. Stated another way, the interface 101 may display a more even distribution between the frame 150 and undercarriage 140. As such, operational efficiency and safety may also be enhanced.

The above noted trough 120 includes a metal structure 127 with a thick protective polymer layer 125 thereabove akin to commercial and non-commercial truck bed liners. For example, in one embodiment, the specialty tubular 110 may be a chrome alloy or otherwise particularly susceptible to damage during transport. Thus, the protective polymer layer 125 may serve to minimize such transport related damage to the tubular 110. Indeed, delivery of the tubular 110 from a pipe rack adjacent the system 100 may be achieved by employment of conventional lifting arms that are also coated with such protective polymer layering for protection of the tubular 110.

Figure 2A:
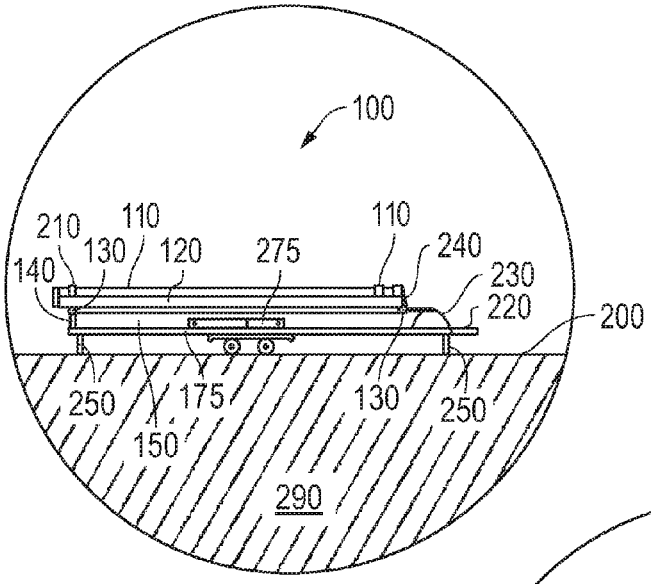
FIG. 2A is a side view of the system of FIG. 1 located at an oilfield in a mobile fashion.
Figure 2B:
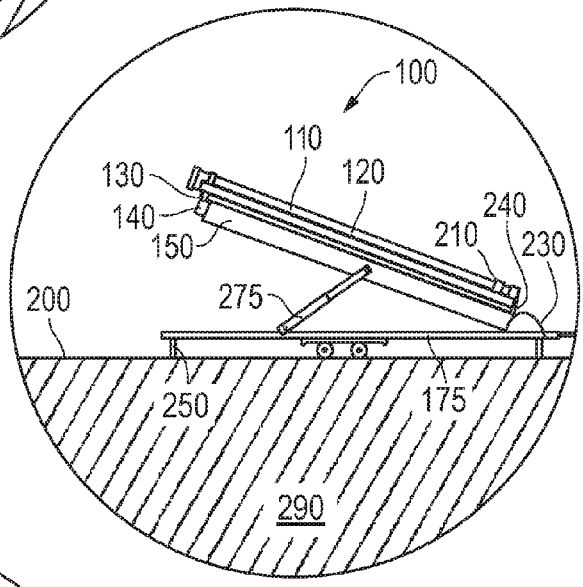
FIG. 2B is a side view of the system of FIG. 2A with a lift frame thereof raised.
Figure 2C:
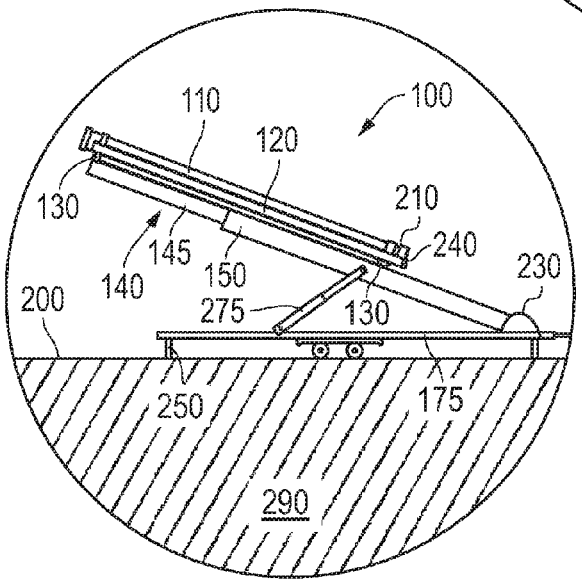
FIG. 2C is a side view of the system of FIG. 2B with a trough thereof extended from the lift frame.

Referring now to FIGS. 2A-2C side views of the tubular positioning system 100 of FIG. 1 are depicted at an oilfield 200. More specifically, a mobile version of the system 100 is shown delivered to the oilfield 200 at FIG. 2A with the lift frame 150 hydraulically elevated at FIG. 2B. Thus, extending of the undercarriage 140 and trough 120 may be employed to deliver a tubular 110 toward a rig floor 320 (see FIG. 3).

With particular reference to FIG. 2A, the system 100 is shown delivered to a location at the oilfield 200 via conventional hitch 220. That is, as noted above a conventional lightweight 30 to 40 ft. trailer bed 175 may accommodate the system 100 due to the lighter weights involved as compared to more conventional casing and heavier weight tubular positioning systems. As shown in FIG. 2A, the system 100 and trailer bed 175 are positioned and mobilized with perhaps about 4 to 10 conventional jack mounts 250. Thus, subsequent elevating, extending and eventual tubular deployment may take place as the tubular 110 is directed to a well 380 running through an underlying formation 290 (see FIG. 3).

With particular reference to FIG. 2B, the lift frame 150 of the system 100 is shown elevated by hydraulic arms 275 disposed between the bed 175 and the frame 150. That is, as the arms 275 are extended from the bed 175, the frame 150 is rotated about a pivot joint 230 thereat. Thus, opposite the joint 230, the frame 150 is raised upward, perhaps 10-40 feet or so above the trailer bed 175. At this point it is worth noting that the trough 120 is equipped with a backstop 240. Therefore, as the trough 120 is elevated at one end, the tubular 110 remains secured within the trough 120 at the other by way of this rear supporting backstop 240. Once more, feet 130 extending below the trough 120 and to the undercarriage 140 help maintain stability thereof as the frame 150 is elevated.

Referring now to FIG. 2C, a side view of the system 100 of FIG. 2B is depicted with the trough 120 being extended from the lift frame 150. For example, the undercarriage 140 may be hydraulically extended out from the frame 150 in a sledding manner as noted above. More specifically, conventional hydraulics may be utilized to forcibly extend the trough 120 and undercarriage 140 as shown with the internal beam 145 sledding along its own polymer layers 147 as it emerges from the frame 150. In the embodiment shown, the polymer layers 147 are provided in the form of discrete pads. However, as noted above, more broadly distributing rails, runners or sliders may be utilized.

Regardless the particular configuration of the polymer layers 147, the sledding nature of the depicted telescopic boom is made practical by the lighter weight of the tubular 110 and overall system 100, as compared to heavier casing positioning systems. Thus, a synthetic fluoropolymer such as conventional polytetrafluoroethylene (PTFE) may be robust enough for effective construction and use of the polymer layers 147 as described without undue concern over premature wear and failure.

Figure 3:
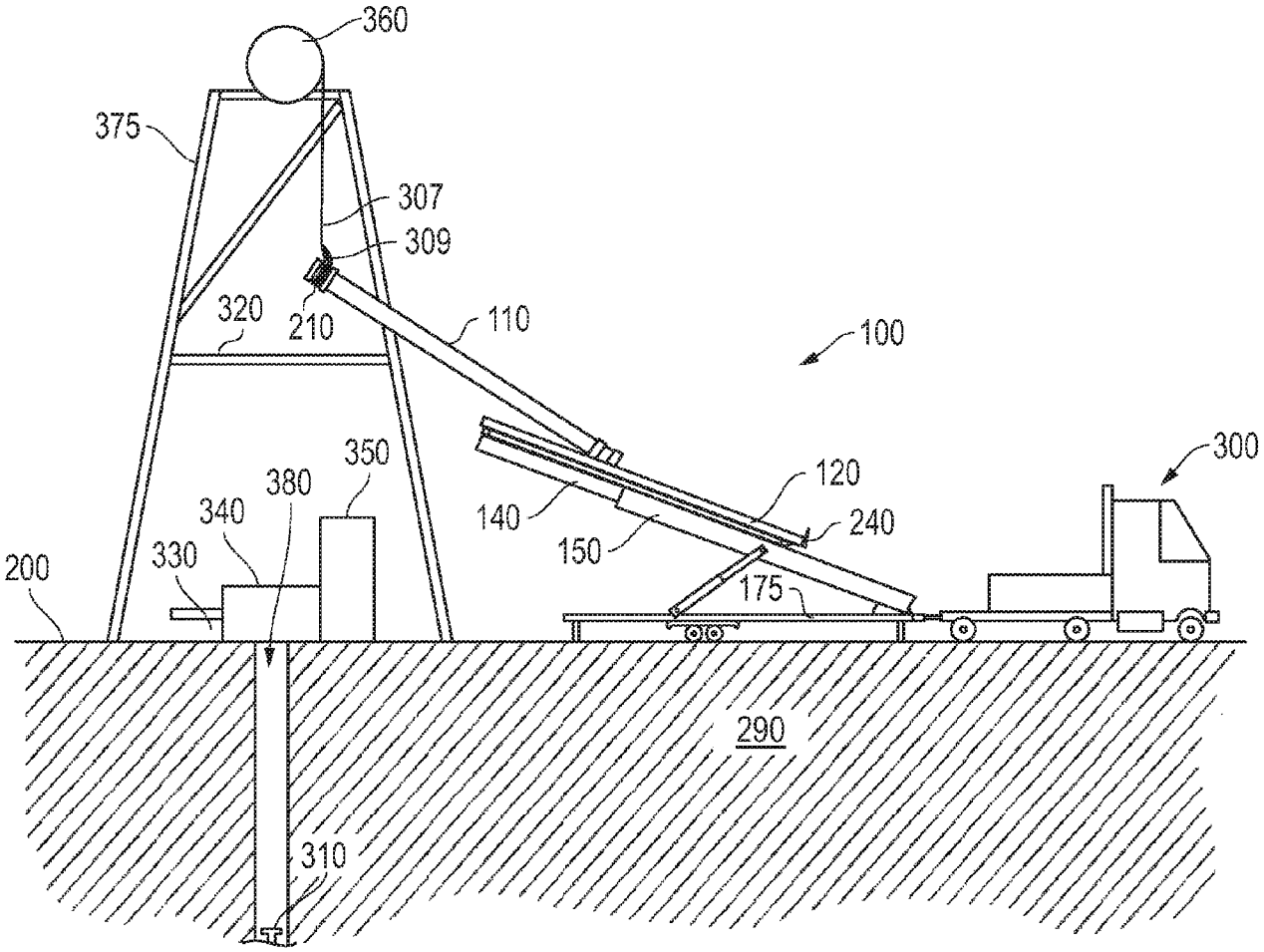
FIG. 3 is an overview of an oilfield accommodating the tubular positioning system of FIGS. 1 and 2A-2C for delivery of a tubular therefrom to a rig floor.

Referring now to FIG. 3, an overview of an oilfield 200 is depicted which accommodates a well 380 traversing a formation. In the embodiment shown, the well 380 may be uncased but configured to accommodate production tubing in the form of the noted tubular 110. Thus, the advantage of a mobile lighter weight tubular positioning system 100 may be quite significant given the lack of a need for any other heavier weight casing positioning system. In the embodiment shown, a mobile truck 300 is shown for system delivery which may be akin to lighter conventional trucks used for gooseneck injector or coiled tubing deliveries. In one embodiment, the truck 300 may be a conventional ¾ to one ton pickup. Of course, even where a heavier weight casing positioning system is initially employed, advantages of the depicted system 100 may be appreciated.

Continuing with reference to FIG. 3, a specialty tubular 110 has been rolled into a trough 120 which has been extended as detailed above. A boosting mechanism such as an elevator or strap 309 is then shown secured to a collar 210 of the tubular 110. That is, once the tubular 110 is extended to within reach of a rig floor 320 of a rig 375 adjacent the system 100, an operator may secure the strap 309 as indicated for removal of the tubular 110 from the trough 120. More specifically, a pulley system 360 of the rig 375 may be utilized to draw up the tubular 110 via an elevator line 307.

The tubular 110 may now be drawn up to a vertical orientation for eventually dropping down past a well head 340 and into the well 380. In this manner, the tubular 110 may be coupled to other production tubulars 310 already disposed in the well 380. Indeed, once complete, production from the well 380 may proceed through such tubular 310, 110 and out a production line 330 with operations directed by a control unit 350 disposed at the oilfield surface 200.

With the fully extended trough 120 approaching the rig floor 320 in the manner shown, concern over dropping of the tubular 110 is minimized. For example, were the strap 309 to come loose or break as the tubular 110 is being removed, it would likely fall back into the trough 120 in a stable manner.

Figure 4:
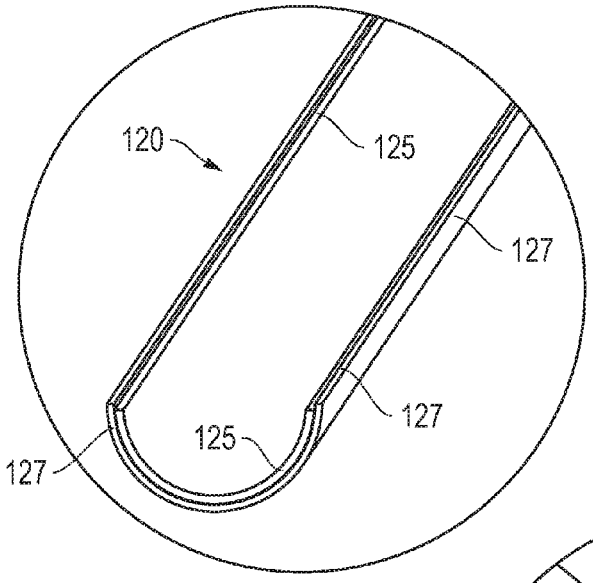
FIG. 4 is a perspective view of the trough of the system of FIGS. 1 and 2A-2C.
Figure 5:
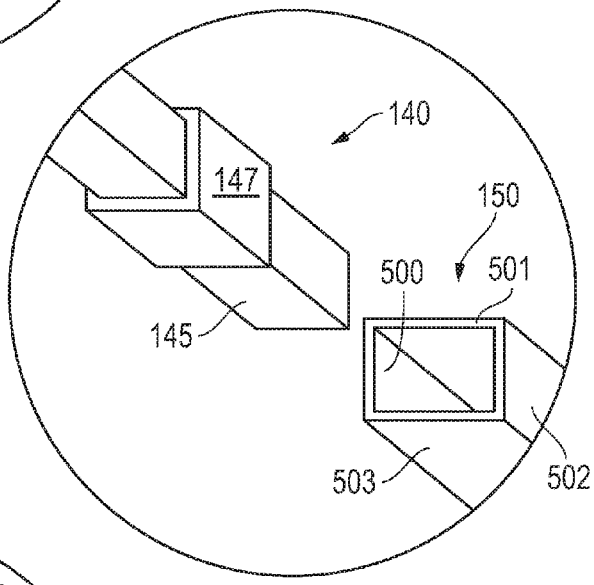
FIG. 5 is an exploded view of the interfacing of the undercarriage of the trough and the lift frame of FIGS. 1 and 2A-2C.
Figure 6:
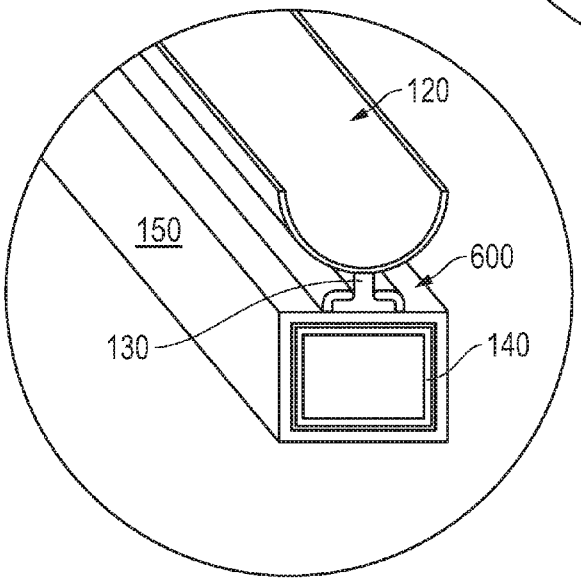
FIG. 6 is a perspective view of an embodiment of a track for securing the trough and its undercarriage to the lift frame of FIGS. 1 and 2A-2C.

Referring now to FIGS. 4-6, different portions of the tubular positioning system 100 of FIG. 1 are described in greater detail. More specifically, a perspective view of the trough 120 is shown in FIG. 4 whereas more detailed features related to the interfacing of the undercarriage 140 with the lift frame 150 are highlighted in FIGS. 5 and 6.

With specific reference to FIG. 4, and additional reference to FIGS. 1 and 3, a perspective view of the trough 120 of the system 100 is depicted. As shown, the trough 120 is of an arcuate or concave shape configured to allow a tubular such as the production tubular 110 hereinabove to rest securely therein for transport to the rig floor 320. Along these lines, given the potential specialty construction materials of the tubular 110, the trough may include a protective polymer layer 125. For example, in one the tubular 110 may be constructed at least partly of a chrome-based material. As such, the trough 120 may be of a supportive structural metal 127 that is coated with a sprayable polyurethane coating to serve as the protective polymer layer 125. Thus, potential damage to the tubular 110 as a result of its own weight and transport may be largely minimized.

Referring now to FIG. 5, an exploded view of the interfacing of the undercarriage 140 with the lift frame 150 is depicted. In the embodiment shown, a discrete pad serves as the polymer layer 147 about the internal beam 145 of the undercarriage 140. However, as noted above, this layer 147 may take a variety of different forms, including a broader slider-type embodiment or be provided in a more elongated or narrow rail-type form. Further, for illustration, the layer 147 is depicted about the beam 145 external the frame 150. However, in an unexploded view such as that of FIG. 1, the layer 147, in pad form or otherwise, would generally remain affixed to the inner surface 500 of the frame 150 during extension of the beam 145.

Regardless, the layer 147 may be of a fluorocarbon such as polytetrafluoroethylene or other suitable non-stick material for allowing a sledding of the beam 145 along the inner surface 500 of the lift frame 150. Such a sledding within the frame 150 may be particularly well suited for embodiments of the system where tubulars 110 such as that of FIG. 1 are of less than about 1,000 lbs. Thus, weight based wear or failure of the layer 147 as a result of shearing during the sledding may be kept to a minimum.

Continuing with reference to FIG. 5, the sledding of the undercarriage 140 within the frame 150 may be controllably guided by the frame 150 itself. That is, in addition to a lower surface 503 over which the undercarriage 140 sleds, the frame 150 includes sidewalls 502, and perhaps even upper lips 501, to help guide the sledding.

Referring now to FIG. 6, a perspective view of an embodiment of a track 600 is shown at the upper portion of the lift frame 150. In this view, the frame 150 is depicted from its rear or 'pivot' end, opposite that shown in FIG. 1. The track 600 is configured to provided added security to the trough 120 and its undercarriage 140 relative the lift frame 150. That is, as the trough 120 and undercarriage 140 are sleddingly extended as depicted in FIG. 2C, additional security and stability may be provided through the use of a track 600. In the embodiment shown, the track 600 is incorporated into the frame 150 in a manner securing feet 130, which emerge from below the trough 120, as the noted sledding takes place. Thus, sufficient security between the trough 120 and frame 150 is ensured. Indeed, with added reference to FIG. 3, the likelihood of the trough 120 accidentally rolling or prematurely dropping a tubular 110 at the rig floor 320 is substantially eliminated.

In one embodiment, the depicted foot 130 may be slid rearward, extending out of the page in the depiction of FIG. 6, thereby exiting the confines of the track 600. When this occurs, the trough 120 may lose a degree of stability relative the frame 150. However, this may be intentionally advantageous. For example, in one embodiment, the rear end of the trough 120 may be configured to engage a receiver plate as the depicted foot 130 leaves the track 600. In such an embodiment, the receiver plate may be configured to rotate the trough 120 relative the frame 150, for example to controllably dump an unused tubular from the assembly.

Figure 7:
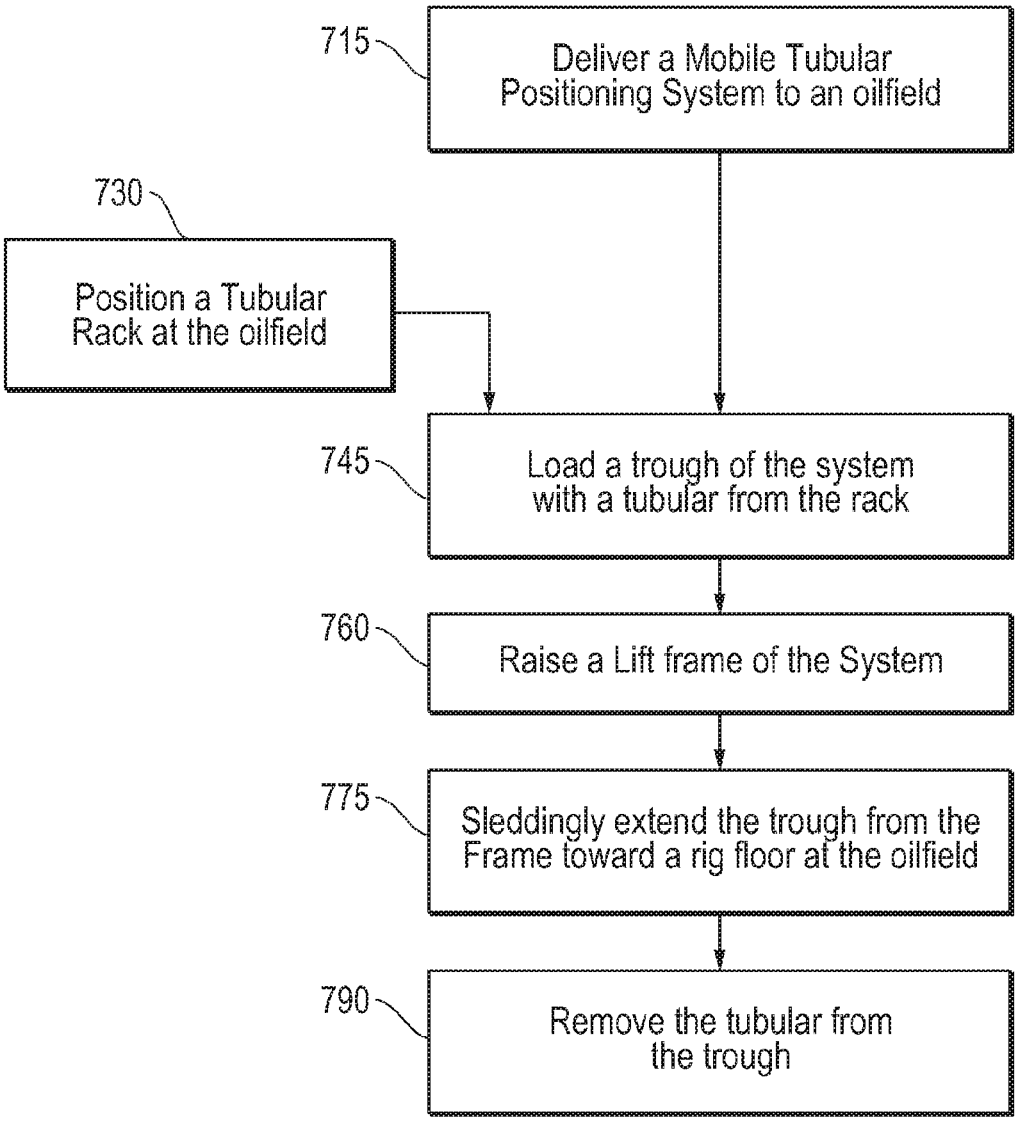
FIG. 7 is a flow-chart summarizing an embodiment of employing a tubular positioning system for delivery of a tubular to a rig floor.

Referring now to FIG. 7, a flow-chart is shown which summarizes an embodiment of employing a tubular positioning system for delivery of a tubular to a rig floor. Namely, a light weight or mobile tubular positioning system may be delivered to an oilfield along with a rack of tubular as indicated at 715 and 730. Thus, a trough of the system may be loaded, one by one, with a tubulars from the rack as noted at 745.

Once a tubular is loaded onto the trough an underlying lift frame may be raised as indicate at 760. Thus, as indicated at 775, extending of the trough from the frame may be undertaken in order to reach the vicinity of a rig floor at the oilfield. As such, the tubular may be removed from the trough as indicated at 790. Perhaps more notably, however, the extending of the trough may be achieved in a sledding fashion. Thus, over time a substantial reduction in maintenance and equipment costs may be realized along with allowing for a lighter system with a greater degree of overall mobility.

The above described embodiments provide a smaller and lighter pickup machine for lighter weight specialty oilfield tubulars. Once more, equipment costs may be kept to about $100,000 in today's dollars without sacrifice of safety features such as stable trough delivery of tubulars. Perhaps most significantly, however, expenses associated with maintenance of the machine or 'tubular positioning system' may be dramatically reduced due to the elimination of a roller-based gantry. Thus, the 'overkill' provided by systems directed at heavier casing-type tubular delivery may be advantageously avoided.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A downhole tubular positioning system for locating at a surface of an oilfield, the system comprising:

a mobile lift frame for elevation approaching that of a rig floor at the oilfield; and a trough coupling to said lift frame for accommodating a tubular; and an undercarriage slidably secured to said frame and affixed to said trough to provide the coupling, the coupling of a rollerless sledded configuration for slidably extending said trough toward the rig floor;

wherein the sledded configuration comprises an interfacing between said frame and said undercarriage for the extending, the interfacing including an outer polymer layer disposed at one of said frame and said undercarriage.

2. The system of claim 1 further comprising at least one hydraulic arm coupled to said lift frame for elevation of one end thereof in advance of the extending.

3. The system of claim 2 wherein said trough further comprises a backstop located at another end thereof to retain the tubular during the elevation.

4. The system of claim 1 wherein the outer polymer layer is of a configuration selected from a group consisting of a substantially broad slider surface, a comparatively narrow runner, and at least one discrete pad.

5. The system of claim 1 wherein the outer polymer layer is comprised of a synthetic fluoropolymer.

6. The system of claim 5 wherein the synthetic fluoropolymer is polytetrafluoroethylene.

7. The system of claim 1 wherein said undercarriage comprises at least one foot for the affixing to said trough and an internal beam to structurally accommodate the outer polymer layer at the interfacing to said frame.

8. The system of claim 1 wherein said lift frame comprises at least one stabilizing element selected from a group consisting of a sidewall, a track, and a lip emerging from said frame to guide said undercarriage during the extending.

9. The system of claim 8 wherein said trough and undercarriage are configured for disengagement from said track.

10. The system of claim 1 wherein a main body of said trough includes a protective polymer layer for contacting the tubular.

11. An assembly for locating at an oilfield surface and comprising:

a rack disposed at the oilfield surface to accommodate a production tubular of less than about 1,000 lbs. in weight;

a rig disposed at a well location of the oilfield surface; and a positioning system having a trough for delivering the tubular to a floor of said rig from said rack, the trough having an undercarriage affixed thereto and slidably retained within a lift frame of said system to support a rollerless sledded extension thereof for the delivering.

12. The assembly of claim 11 wherein the tubular comprises a collar and said rig comprises a strap for securing to the collar for removal of the tubular from the trough during the delivering.

13. A method of delivering a downhole tubular to a rig floor at an oilfield, the method comprising:

extending a trough accommodating the tubular toward the rig floor from a lift frame of a positioning system located at a surface of the oilfield, said extending of the trough comprising extending of an undercarriage affixed to the trough and slidably retained within the frame for rollerless sledded extending.

14. The method of claim 13 further comprising locating the system at the surface by way of a mobile trailer in advance of said extending.

15. The method of claim 13 further comprising elevating an end of the lift frame in advance of said extending.

16. The method of claim 15 wherein said elevating and said extending are achieved in a hydraulic fashion.

* * * * *